US007477504B1

(12) United States Patent
Delida

(10) Patent No.: US 7,477,504 B1
(45) Date of Patent: Jan. 13, 2009

(54) VERSATILE STUN GLOVE

(75) Inventor: Christopher P. Delida, Cocoa, FL (US)

(73) Assignee: C.P.D. Technologies, Inc., Cocoa, FL (US)

( * ) Notice: Subject to any disclaimer, the term of this patent is extended or adjusted under 35 U.S.C. 154(b) by 222 days.

(21) Appl. No.: 11/374,602

(22) Filed: Mar. 13, 2006

(51) Int. Cl.
*F41B 15/04* (2006.01)

(52) U.S. Cl. ..... 361/230; 361/232; 361/235

(58) Field of Classification Search ..... 361/230, 361/232, 235
See application file for complete search history.

(56) References Cited

U.S. PATENT DOCUMENTS

| | | | | | |
|---|---|---|---|---|---|
| 1,915,721 | A | * | 6/1933 | Diaz | 361/232 |
| 3,819,108 | A | | 6/1974 | Jordan | 231/2 E |
| 4,059,830 | A | * | 11/1977 | Threadgill | 340/575 |
| 4,242,715 | A | | 12/1980 | Laird | |
| 4,337,496 | A | | 6/1982 | Laird | 361/232 |
| 4,485,426 | A | | 11/1984 | Kerls | 361/232 |
| 4,922,850 | A | | 5/1990 | Conley | 116/222 |
| 5,024,136 | A | | 6/1991 | Bock | 89/6 |
| 5,113,325 | A | | 5/1992 | Eisenbraun | 362/103 |
| 5,282,481 | A | * | 2/1994 | Ziemer | 607/145 |
| 5,289,164 | A | | 2/1994 | Novak | 340/574 |
| 5,379,179 | A | | 1/1995 | Graves | 361/232 |

(Continued)

FOREIGN PATENT DOCUMENTS

JP 2003-031071 * 1/2003

OTHER PUBLICATIONS www.iconoclast.org/weapons/powered, copyright 1996-2003, pp. 1-3 printed May 23, 2003.

(Continued)

*Primary Examiner*—Michael J Sherry
*Assistant Examiner*—Zeev Kitov
(74) *Attorney, Agent, or Firm*—Brian S. Steinberger; Law Offices of Brian S. Steinberger, P.A.

(57) ABSTRACT

A versatile stun glove having at least two electrodes placed in the palm region, and/or on the back of the hand and/or on the fingers of the glove. A rechargeable power supply that uses simple thin diameter and thickness replaceable batteries for powering the electrodes. Batteries can include 9-volt battery, a double A, and triple A batteries. A thin watch battery can also be used so that no protrusions extend outward from the glove body. The power supply can be located in the palm region and/or on the back of the hand of the glove. The power supply can be accessed by a foldable panel cover that can be removed by hook and loop fasteners (Velcro®), snaps, a zipper and the like. The power can be activated by a simple switch located adjacent to the finger tip of the index finger of the user so that touching the tip of the thumb against the index finger tip activates the power. An alternative activation source can be a pressure sensor that is underneath one of the electrodes so that pressing the at least one electrode into an assailant activates the power. A novel stand and power supply recharge allows for the glove to be mounted to a vehicle cigarette lighter. The location of the stand allows for the glove to be easily accessible and reachable when needed by the user. A stun stick accessory can allow for the glove discharge to have greater reach to attackers and assailants.

12 Claims, 14 Drawing Sheets

U.S. PATENT DOCUMENTS

| | | | | |
|---|---|---|---|---|
| 5,392,552 | A | 2/1995 | McCarthy et al. | 42/70.07 |
| D364,208 | S | 11/1995 | Larson | D22/117 |
| 5,484,085 | A | 1/1996 | Bennett | 222/175 |
| 5,655,223 | A | 8/1997 | Cozza | 2/161.2 |
| 5,686,811 | A | 11/1997 | Bushong et al. | 320/110 |

OTHER PUBLICATIONS www.scs.wsu.edu/~pbourgue/framemain.hts, Jul. 20, 1999, p. 1, 2 and Compendium of Modern Armaments, pp. 1-7 printed May 17, 2003.

* cited by examiner

Fig. 3
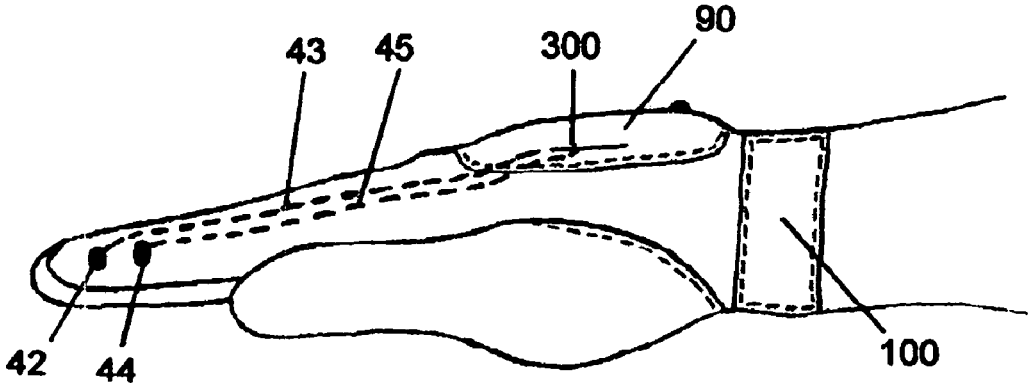
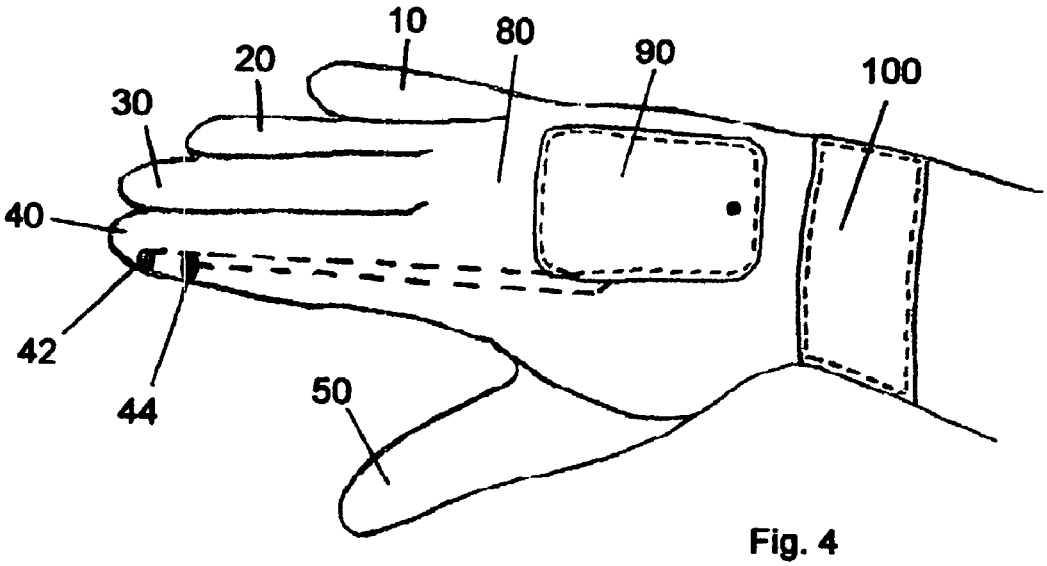
Fig. 4

Fig. 7
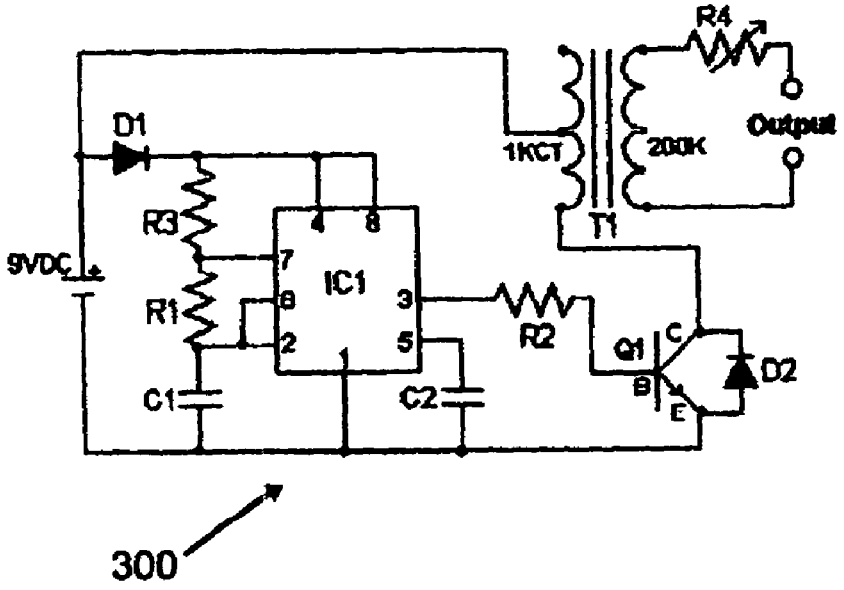
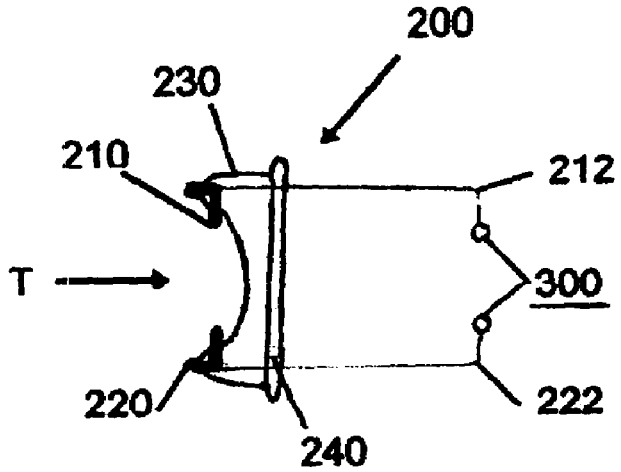
Fig. 8
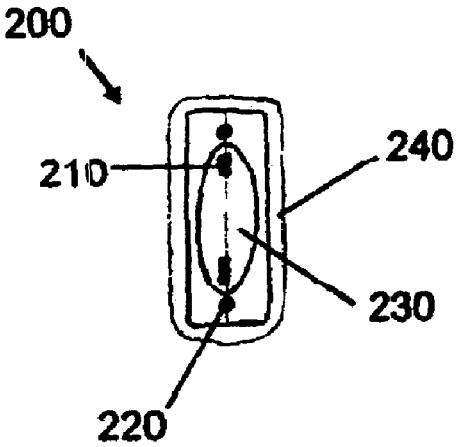
Fig. 9

Fig. 11A
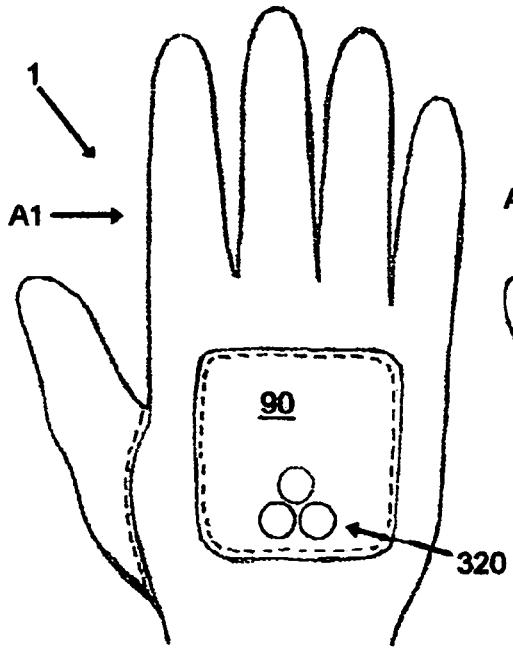
Fig. 12A
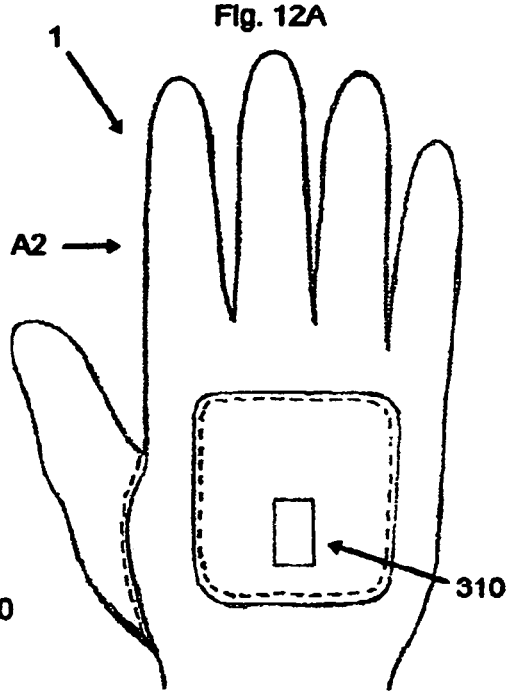
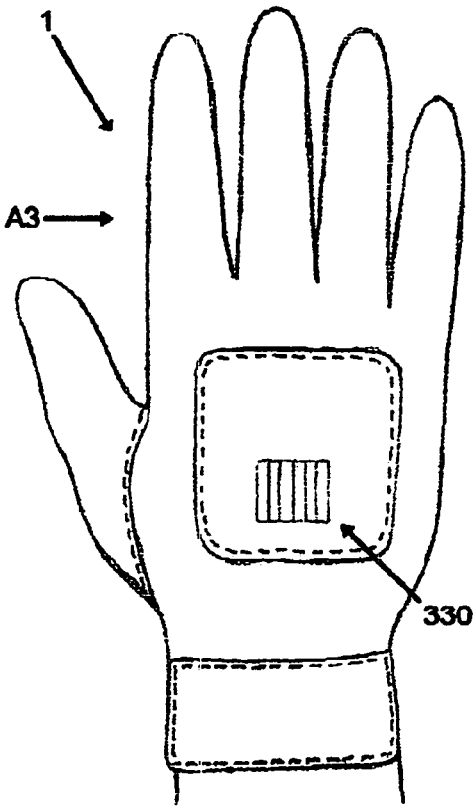
Fig. 13A
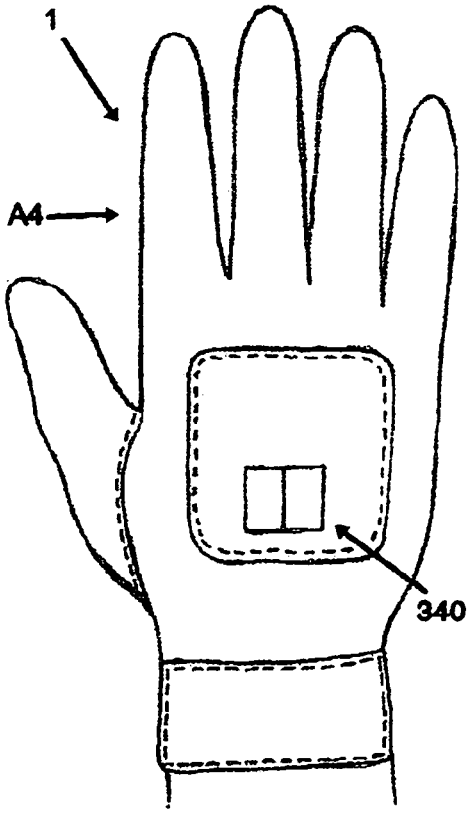
Fig.14A

VERSATILE STUN GLOVE

This invention relates to personal defense, in particular to self defense glove with battery powered electrodes that can be used to shock, subdue, and disable attackers.

BACKGROUND AND PRIOR ART

Various types of electrical self defense weapons have existed for years. Crowd control sticks such as electrical batons allow for users such as law enforcement personal to generate an electrical shock at the end of an elongated stick. See U.S. Pat. No. 3,819,108 to Jordan. However, the batons require the user physically hold the device itself.

In more recent years, the popular "tazar" type device allows a user to grip a handheld weapon that emits a visible electric lightening type signal between two outer electrodes. However, these handheld "tazars" must be constantly gripped by the user who is restricted from using that same hand and fingers for anything else. By eliminating one of their hands, the "tazer" can ultimately be taken away by an overpowering assailant. A locking container was proposed for the handheld "tazar." See U.S. Pat. No. 5,379,179 to Graves. However, this locking container requires the user insert their hand into a bulky and clearly uncomfortable appearing container that is closed about the wrist. In addition to being bulky, this container further restricts the usefulness of the user's fingers and hand so that the user is only able to grip their "tazar" weapon.

Hand and finger type devices have been proposed as electrical weapons. See U.S. Pat. No. 4,337,496 to Laird and U.S. Pat. No. 5,282,481 to Ziemer. However, these devices have little versatility when being used, as well as other problems. The Laird '496 only allows for attaching an electrode to a single finger such as the index finger, which can cause the user to shock themselves when that finger is bent back to the user's palm. Furthermore, by restricting the electrode to the outer front tip of the finger, the user may not always be able to shock their assailant if their electrode finger tip is not being pressed into the assailant. The Ziemer device requires their electrodes be on the knuckles of the user, which requires the user to punch the assailant to work, since the device would not provide a shock effect when the user is grabbing an assailant. Still furthermore, both references require loose electrical conductors that run back from the finger/knuckle region to power packs that are attached to the wrist or forearm of the user. The loose conductors can easily get caught and pulled apart during an attack rendering these devices useless. Furthermore, the power packs are large and bulky, and with the loose conductors can further restrict the movement of the user when they are being attacked. Still furthermore, both devices requires on and off switches for the devices to be located on the wrist/forearm location, which requires the user use their other hand to activate the device. This extra step that delays the activation of the device can be dangerous when one is unexpectedly attacked by an assailant and has no advance time to react.

Various types of glove systems have also been proposed by that give an electrical shock to an assailant. See U.S. patents: U.S. Pat. No. 1,915,721 to Diaz; U.S. Pat. No. 4,485,426 to Kerls; and U.S. Pat. No. Des. 364,208 to Larson. However, these patents also have additional problems with being effectively used.

The Diaz '721 patent requires a separate battery power supply be carried in a case that has an elongated connector line to the glove, the latter of which can also be snagged and removed rendering the device useless. Also, this device has no easy way of being turned on and off, since a button on the battery must be separately pressed by the user's other hand. This extra step that delays the activation of the device can be dangerous when one is unexpectedly attacked by an assailant and has no advance time to react.

The Kerls '426 patent in FIGS. 6-7 shows a glove with electrodes on an index finger and a thumb with an activation switch on the back of the same hand. Clearly, this device is also not easy of being turned on and off, since this "toggle" type switch is separately pressed by the user's other hand. This extra step that delays the activation of the device can be dangerous when one is unexpectedly attacked by an assailant and has no advance time to react. Still furthermore, there appears to be no easy way to access the battery component in these figures for changing out burned out batteries and/or for recharging the batteries, without having to tear apart the entire back of the glove. Thus, this glove appears to have limited use and lifespan.

The Larson '208 patent shows a design patent that clearly requires some type of power pack on the wrist of the user, which connects by electrical conductors to the electrodes in the palm area of the glove. This power pack appears to require substantial space and would clearly be uncomfortable by being located on the user's wrist, and its' location would further restrict the mobility of the user. Furthermore, the open tip ends of this "glove" would allows a user to easily contact the electrodes with any of their bare finger tips shocking themselves. Still furthermore, the apparent activation switch is along the knuckle region of the index finger of the user and would be difficult to reach unless the user bends their thumb and then in an uncomfortable position try to aim their thumb tip to press a contact point to activate a switch. This extra step that delays the activation of the device can again be dangerous when one is unexpectedly attacked by an assailant and has no advance time to react. Still furthermore, there appears to be no easy way of changing out the power pack to replace batteries, and/or recharge the unit once the power runs out.

SUMMARY OF THE INVENTION

The first objective of the present invention is to provide a versatile stun glove with electrode contacts that allows the wearer to easily activate the glove with the same hand as the glove without unnecessary delays.

The second objective of the present invention is to provide a versatile stun glove with electrode contacts that does not allow the user to shock themselves with the same hand as that wearing the glove.

The third objective of the present invention is to provide a versatile stun glove with electrode contacts with power supply having no loose or visible wire conductors that restrict hand and finger movement that can disconnect the power supply by accident, nor provide any discomfort to the wearer.

The fourth objective of the present invention is to provide a versatile stun glove with electrode contacts having easily replaceable and inexpensive battery power supplies.

The fifth objective of the present invention is to provide a versatile stun glove with electrode contacts having an easily rechargeable power supply.

The sixth objective of the present invention is to provide a versatile stun glove with electrode contacts that can be recharged by an automobile cigarette lighter.

The seventh objective of the present invention is to provide a versatile stun glove with electrode contacts that can be held in a stand adjacent to a cigarette lighter for easy reach and access by the user.

Embodiments of the novel versatile stun glove can include a flexible main body that can be worn over the hand of a user.

The glove can have a pair of electrodes on the lower palm portion of the glove, and a rechargeable and/or removable battery power supply on the back hand portion of the glove between the knuckle region and the wrist portion of the glove so that the location of the power pack does not interfere with the movement of ones' hands. Unlike prior devices the novel glove can use replaceable 9 volt batteries, A type batteries, and even small watch size batteries, that do not protrude upward and/or away from the glove body.

Household rechargers can be used to recharge the glove while it is not in use. Cigarette type power adapters can also be used to recharge the glove power supply. A novel vehicle stand attached to the cigarette lighter can allow the glove easy accessibility to the user when the glove is not being used. Control panels can be used to allow for access codes to restrict the use of the glove to authorized persons. Power readouts, and power output controls can also be used with the glove. A stun stick attachment accessory can be used to extend the reach of the glove.

Further objects and advantages of this invention will be apparent from the following detailed description of the presently preferred embodiments which are illustrated schematically in the accompanying drawings.

BRIEF DESCRIPTION OF THE FIGURES

FIG. 3 is a side view of the stun glove of FIGS. 1-2.

FIG. 4 is a tilted back side view of the stun glove of the preceding figures.

FIG. 7 shows the electronic circuit used in the back of the glove.

FIG. 8 shows an enlarged side view of the electrodes for use in the glove.

FIG. 9 is a top view of the electrodes of FIG. 8 along arrow T.

FIG. 11A shows the back side of the glove using 3 3volt "watch" size batteries.

FIG. 12A shows the back side of the glove with a single 9 volt battery.

FIG. 13A shows the back side of the glove with up to six 1.5 V double A, triple A type batteries.

FIG. 14A shows the back side of the glove with two 9 volt batteries.

FIG. 17A is an enlarged view of the touch screen pad of FIG. 17.

DESCRIPTION OF THE PREFERRED EMBODIMENTS

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

Figure 1:
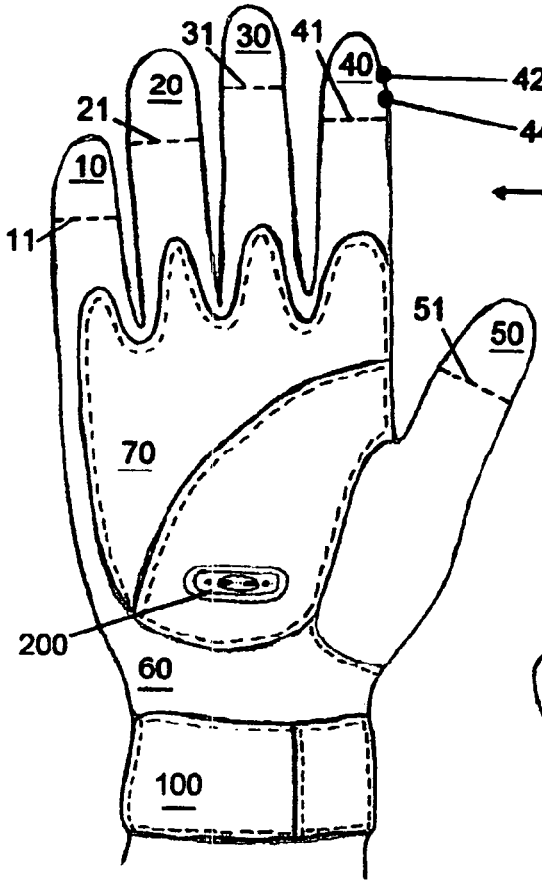
FIG. 1 is a palm side view of a preferred embodiment of the versatile stun glove.
Figure 2:
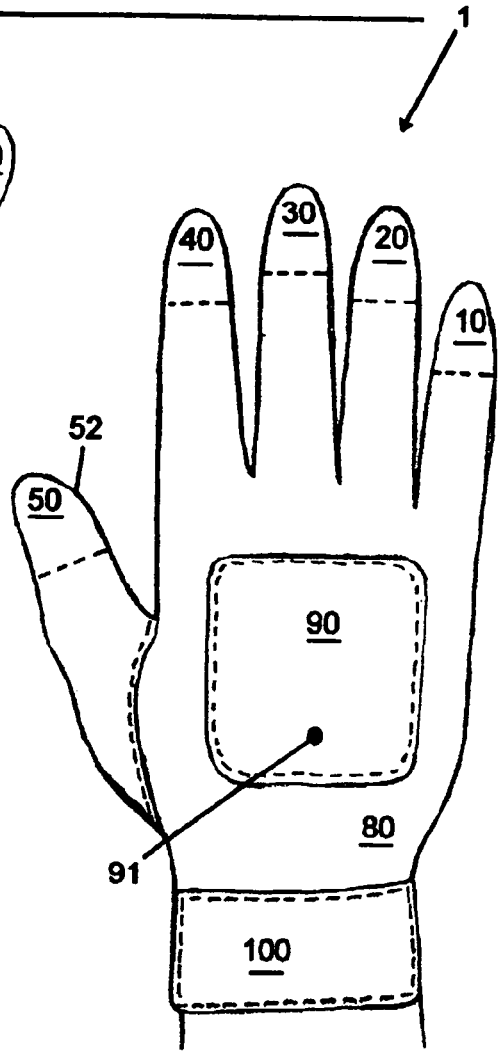
FIG. 2 is a back side view of the stun glove of FIG. 1.

FIG. 1 is a palm side view of a preferred embodiment of the versatile stun glove 1. FIG. 2 is a back side view of the stun glove 1 of FIG. 1. FIG. 3 is a side view of the stun glove 1 of FIGS. 1-2. FIG. 4 is a tilted back side view of the stun glove 1 of the preceding figures. Referring to FIGS. 1-4, the stun glove 1 can be formed from a thin flexible and strong material, such as leather, lycra, and the like, that substantially covers each of five fingers, pinky 10, fourth finger 20, middle finger 30, index finger 40 and thumb 50, palm area 60 and back of hand area 80. A thin almost transparent dome shaped sublayer of insulative material, such as latex, can line the tip portions 11, 21, 31, 41, 51 of each of the fingers so that a user will not be able to shock themselves when touching their fingers to the electrodes 200 (shown and described in more detail in reference to FIGS. 8-9). The electrodes 200 can be mounted on a palm material 70 such as an insulative material, such as but not limited to rubber layer, latex, neoprene, and the like. Preferably a double insulative layer 70 can be used for optimum insulation of the bare hand of the user from the electrodes 200. The base of the glove 1 can include a fastener band 100, having hook and loop fasteners, snaps, and the like, which allows the glove 1 to be easily attached about the wrist of a user so that the glove 1 cannot be unintentionally removed from the user.

The stun glove can be activated by a simple pressure activated type arming switch 44, that can be located on the side tip region of the index finger 40, so that the user must press the tip region 52 of their thumb into the switch 44 to activate the stun glove 1. The arming switch can be a push button on/off switch such as but not limited to a Tandy Corporation Part #2751565, that can be sewn into the tip of the index finger 40, having an insulative mount backing, such as but not limited to gasket type rubber, latex, neoprene, and the like. An extra safety switch 42, such as an additional pressure activation switch identical to the activation switch 44, can be located adjacent to the main activation switch 44, so that a user must separately press into each switch in order to activate the stun glove 1. Imbedded wire leads 43, 45, can run from the switches 42, 44 to the circuit board 300 (shown and described in reference to FIGS. 6-7) under the removable back cover portion 90 on the back 80 of the glove 1.

Figure 5:
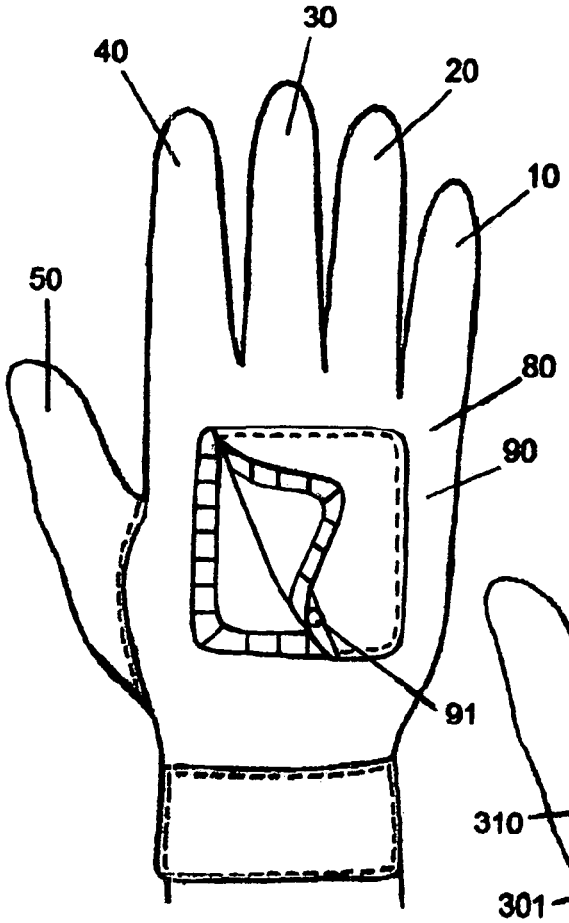
FIG. 5 is a back side view of the stun glove of FIG. 2 with back panel being peeled back.
Figure 6:
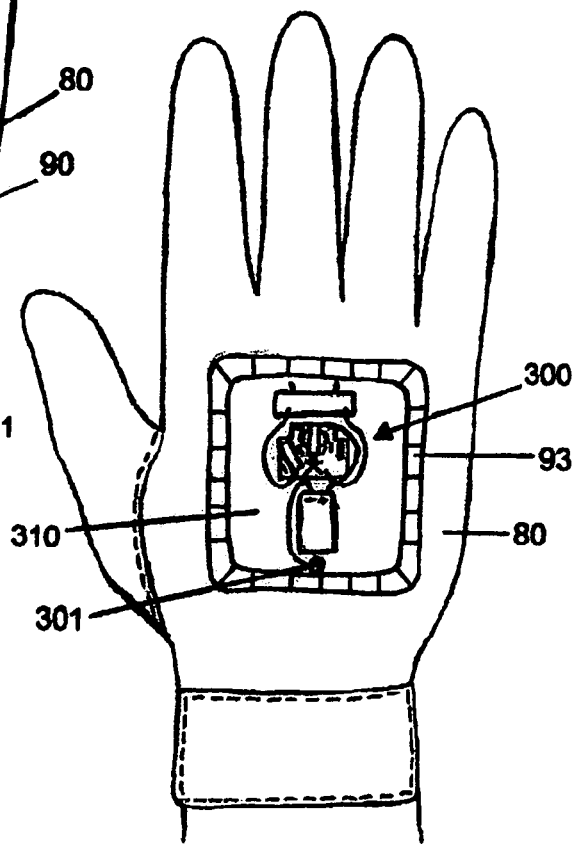
FIG. 6 is another view of the back of the stun glove with back panel removed.

FIG. 5 is a back side 80 view of the stun glove 1 of FIG. 2 with back panel 90 being peeled back. FIG. 6 is another view of the back 80 of the stun glove 1 with back panel 90 removed. The back panel 90 can be double layered, with an outer layer formed from a glove type material similar to that of the glove body itself, previously described, along with an insulative type sub-layer material similar to those previously described, and can preferably have its edges mounted by hook and loop type fasteners 93 (i.e. Velcro®). Additionally, the fasteners 93 can be snaps, plastic zipper(s) and the like. A small through-hole 91 in the panel 90 can allow for a small bulb type light 301 in the circuit 300 to be used as a power source indicator as to whether the battery power supply is running low or is out. For example, a flickering light can indicate low power, a constant red light means full power, and the like.

FIG. 7 shows the electronic circuit 300 used in the back of the glove 1 of the preceding figures. Table 1 lists the electronics that can be used in the circuit.

TABLE 1

| | |
|---|---|
| Resistors: | R1, R2: 1K |
| | R3: 47K |
| | R4: 1M Variable (optional) |
| Capacitors: | C1: 0.1 or 0.47 micro F |
| | C2: 0.01 micro F |
| Diodes: | D1: 914 or INJ4148 |
| | D2: 1N4005 |
| Transistors: | Q1: TIP 31 |
| Circuit Board: | IC1: 555 |
| Transformer: | Miniature Audio Transformer 200K to 1K CT INPUT |
| Battery: | One 9 Volt Alkaline (other embodiments can use different batteries) |

The circuit 300 can sit on a nonconductive base 310 such as but not limited to a thin layer of latex, gasket material, neoprene, and the like. Surrounding the electronics circuit 300 can be a protective layer of plastic, and the like, that can be molded to the anatomical curve shape of the back of the hand, maintaining a low profile. The protective layer of plastic can be held in place by adhesive. The entire thickness of the plastic base and circuit board with electronics, can be no more than approximately ½ inch in height, and also much smaller if miniaturized.

FIG. 8 shows an enlarged side view of the electrodes 200 for use in the glove. FIG. 9 is a top view of the electrodes 300 of FIG. 8 along arrow T. Referring to FIGS. 1, 8 and 9, the electrodes 200 in the first preferred embodiment 1 can be located in the mid-palm area, of the palm area 60 of the glove 1, just distal from the wrist portion 100 of the glove 1. There are two different electrodes 210, 220 that can each be very conductive and non corrosive material, such as but not stainless steel, copper plated, gold plated, and the like. The individual electrodes 210, 220 suspended in plastic type holder 230. A thin layer of insulative material 240, such as but not limited to latex, rubber, neoprene, and the like. Wire leads 212, 222 from the electrodes 210, 220 can be soldered at the curvature portion of the electrodes 210, 220. The plastic holder 230 can be attached to the insulative base 240 by adhesive such as but not limited to epoxy, and the like. The wire leads 212, 222 can be routed from the electrodes 210, 220 to the circuit 300 on the back of the glove 1, by running through the glove material about the natural fold areas of the palm, to the midline of the hand within the glove 1.

In operation, the stun glove can be used for self-defense, and the like, to subdue and/or fend off an attacker or assailant, and/or to gain greater leverage in a hostile physical situation. In operation, once the glove 1 is activated the battery supplies power to the circuit 300, and can supply an electric arc discharge between the two exposed electrodes 200 on the palm portion of the glove 1 that can be between approximately 20,000 to approximately 150,000 volts. The electric pulses can move into the attacker/assailant that is contacted between the electrodes in a well known application as described in reference to U.S. Pat. No. 3,803,463, which is incorporated by reference. The gap allows for the moving current to pass between the electrodes, and the moving current ionizes the air particles in the gap space producing a visible spark and crackling noise, the display of which also can cause pause to the attacker/assailant or person(s) as used in self-defense that see and hear the sparks and crackling noise.

The electric discharge can be non-lethal and works in principle where the high voltage pulses are applied to a persons muscles causing instant and overwhelming fatigue, loss of balance, and even temporary confusion and even temporary paralysis. The user merely needs to hold onto the other person. Different power supplies can be used, where the higher the voltage of the glove, the less contact is needed.

Figure 10:
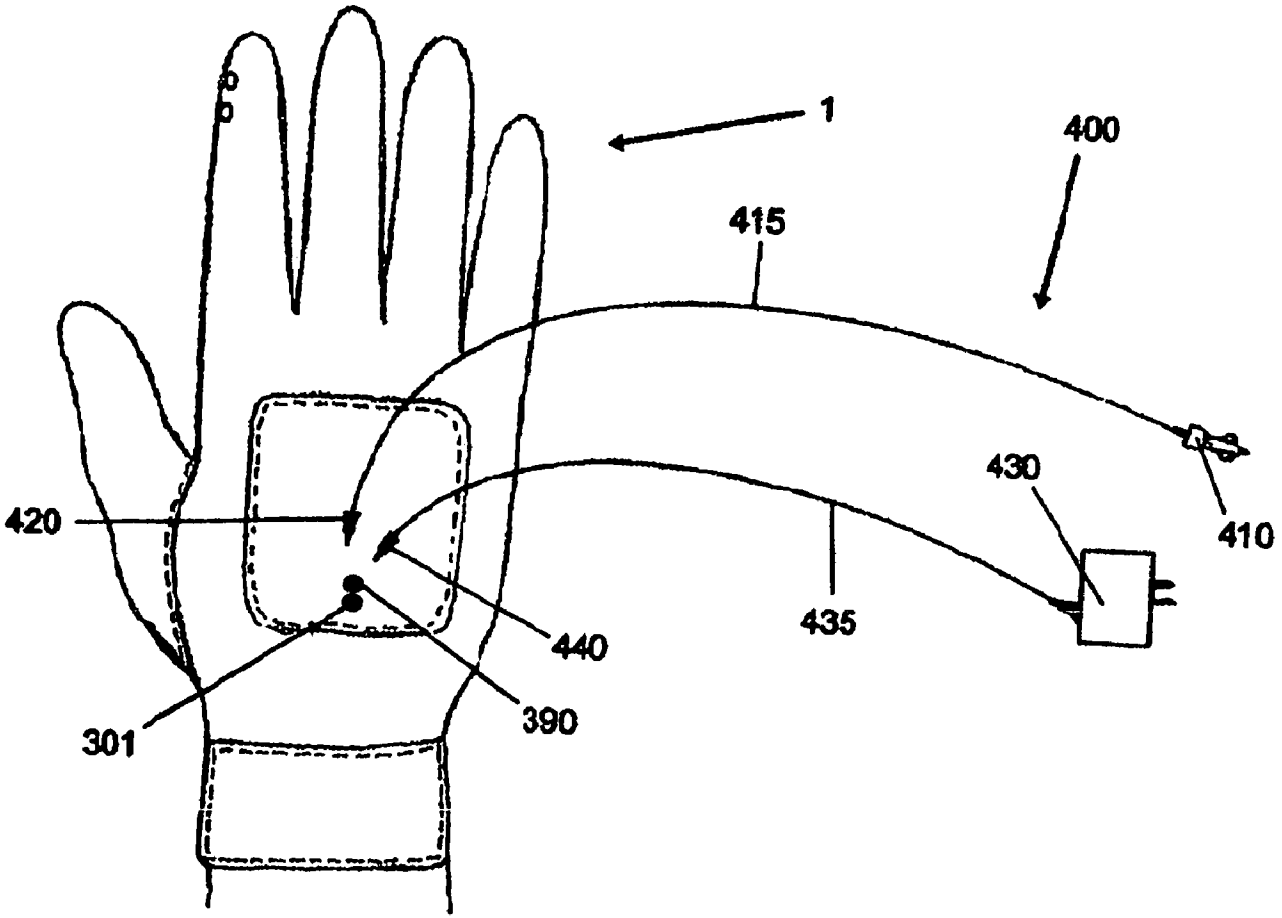
FIG. 10 shows the rechargeable power adapters that can be used with the glove.

FIG. 10 shows the rechargeable power adapters 400 that can be used with the glove 1. A cigarette type adapter 410 that can be plugged into a conventional vehicle cigarette lighter can supply a 12 Volt DC power supply by line 415 to a second plug 420 that can plug into a female receptacle 390 that is connected to the battery supply within circuit 300 previously described. Conventional power converters can allow for recharging the battery within the circuit 300. A secondary type of power adapter can include a wall plug power adapter 430 such as a 120 Volt AC charger that can connect power through a feed line 435 to a secondary plug 440 that attaches to female receptacle 390, as well.

Figure 11B:
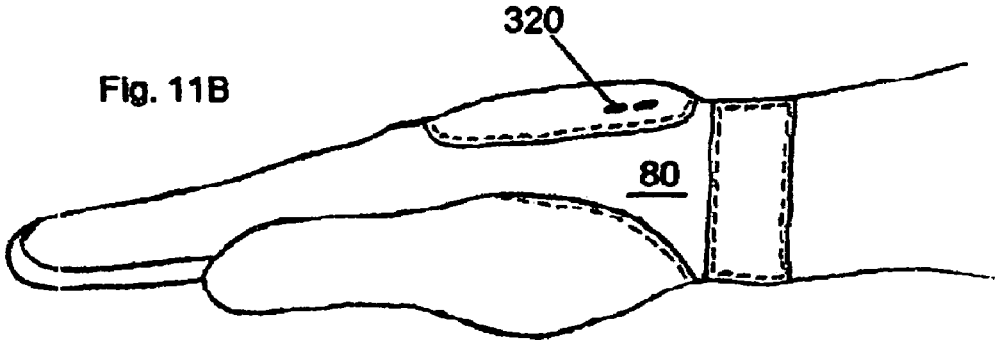
FIG. 11B is a side view of the glove of FIG. 11A along arrow A1 with three 3 V batteries.

FIG. 11A shows the back side of the glove 1 using three 3 volt "watch" size batteries 320 as the power supply. FIG. 11B is a side view of the glove 1 of FIG. 11A along arrow A1 with three 3 V batteries 320. The thin 3 volt batteries can be literally built into the glove 1 and do not add any significant additional thickness to the height on the back hand portion 80 of the glove 1 more than a fraction of an inch.

Figure 12B:
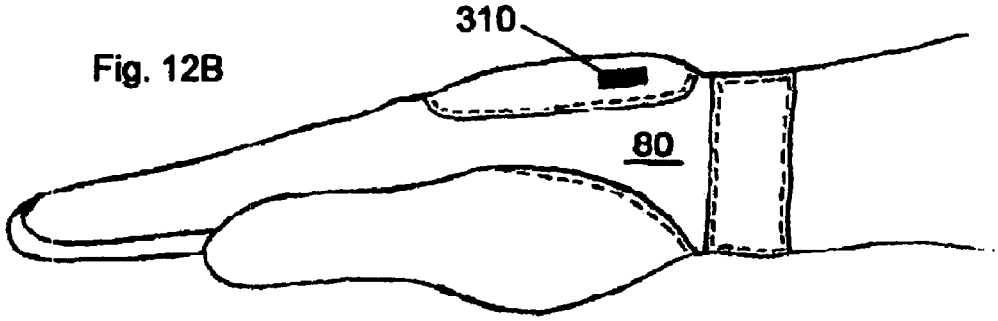
FIG. 12B is a side view of the glove of FIG. 12A along arrow A2 with a single 9V battery.

FIG. 12A shows the back side of the glove 1 with a single 9 volt battery 310 as the power supply. FIG. 12B is a side view of the glove 1 of FIG. 12A along arrow A2 with a single 9V battery 310. The thin 9 volt battery can also be literally built into the glove 1 and does not add any significant additional thickness to the height on the back hand portion 80 of the glove 1 more than the thickness of the battery itself.

Figure 13B:
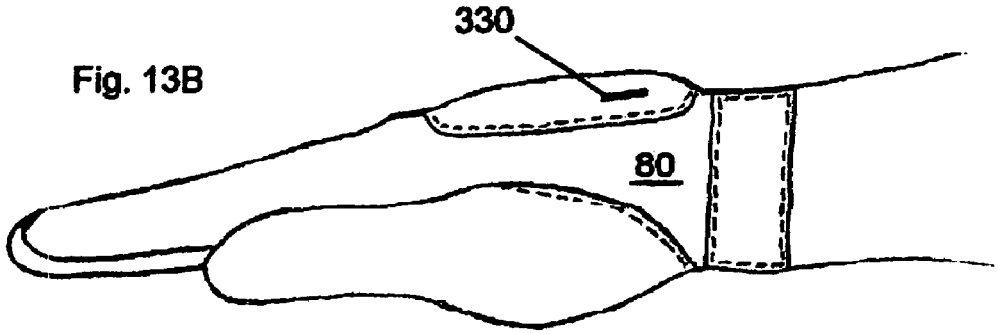
FIG. 13B is a side view of the glove of FIG. 13A along arrow A3 with six 1.5V batteries.

FIG. 13A shows the back side of the glove 1 with up to six 1.5 V AAAA type batteries 330. FIG. 13B is a side view of the glove 1 of FIG. 13A along arrow A3 with six 1.5V batteries 330. These batteries can be laid side by side to one another and can also be literally built into the glove 1 and do not add any significant additional thickness to the height on the back hand portion 80 of the glove 1 greater than the diameter of the batteries. Single A, double A and triple A batteries can also be adapted to the glove 1.

Figure 14B:
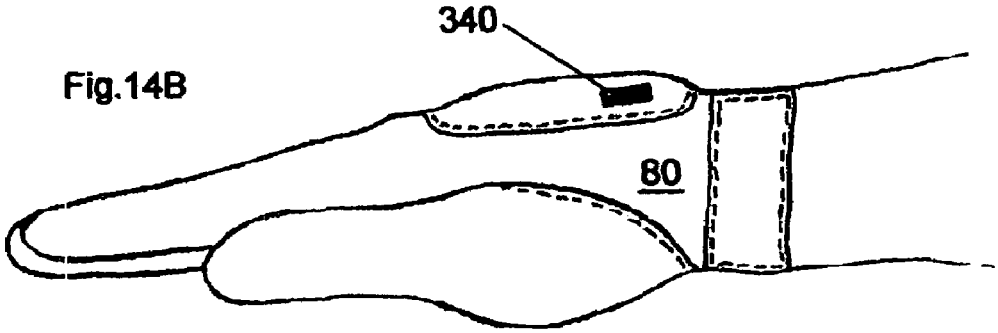
FIG. 14B is a side view of the glove of FIG. 14A along arrow A4 with two 9V batteries.

FIG. 14A shows the back side of the glove 1 with two 9 volt batteries 340. FIG. 14B is a side view of the glove 1 of FIG. 14A along arrow A4 with two 9V batteries 340. These batteries 340 can also be placed side by side to one another, and do not add any significant additional thickness to the height of the back hand portion 80 of the glove other than the thickness of batteries 340.

The adapters 410 and 430 can also be used with the different battery power supplies described in reference to FIGS. 11A, 11B, 12A, 12B, 13A, 13B, 14A, and 14B described above.

Figure 15:
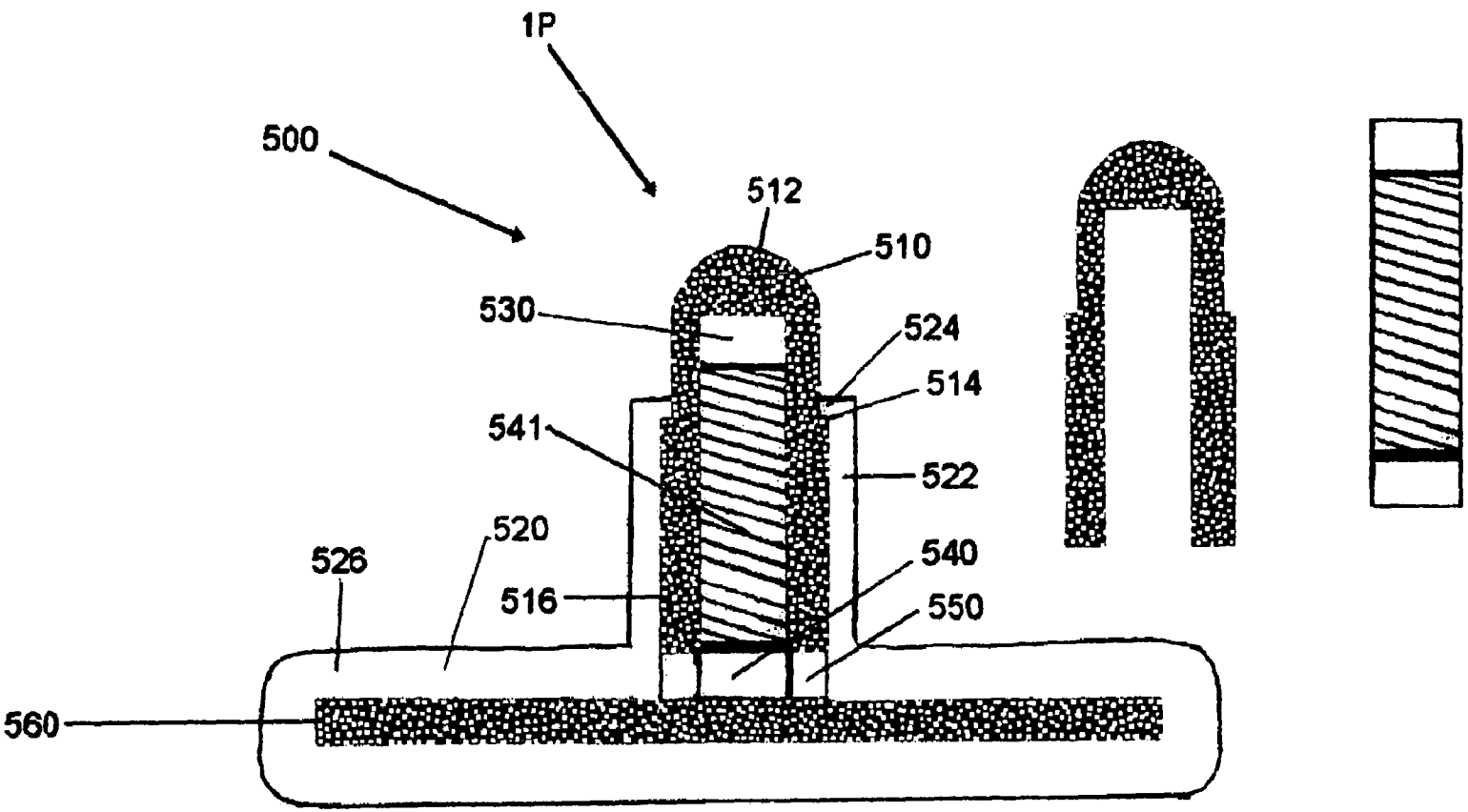
FIG. 15 is an enlarged side view of a pressure sensitive electrode activation switch that can be used with the invention.

FIG. 15 is an enlarged side view of a pressure sensitive electrode activation switch 500 that can be used with the glove 1 embodiments. The novel electrode/pressure switch 500 can be used in place of the finger tip activation switch 44 depicted in FIGS. 1-2. Here, two of the novel electrode/pressure switch 500 can be located in place of the electrodes 300 shown in reference to FIG. 1. Each electrode/pressure switch 500 can include an hollow dome shape material 510 formed from a conductive and non corrosive material, such as but not stainless steel, copper plated, gold plated, and the like, with a rounded dome upper surface 512. Step side portions 514 of the electrode dome 510 can be housed and held in place within interior shoulder portions 524 of an upper protruding portion 522 of a plastic holder 520 which has a lower horizontal plastic portion 526 for housing a conductive contact plate 560. Inside the hollow dome shaped electrode 510 can be a spring member 540 sandwiched between plastic end caps 530, 540, and a cylindrical open space 550 can exist under the base ends 516 of the dome shaped electrode 510. Pressing down on the rounded dome portion 512 in the direction of arrow P compresses spring 540 until base ends 616 of the dome electrode contacts plate 560 which conducts electricity to the electrode 510. The novel pressure sensitive electrode switch 500 allows the user of the glove 1 to activate the electrodes 500 for firing a discharge when the user grabs an assailant. Once activated, an arc voltage discharge can pass between the electrodes shocking and disabling the assailant. The novel pressure sensitive electrodes 500 eliminate any delays that can occur by requiring the user to separately activate the glove through a separate activation switch 44.

The novel pressure sensitive electrodes 500 can also be used with the safety switch 42 depicted in FIGS. 1-2 as needed so that an extra arming step is used to activate the glove 1. For example, switching on safety switch 42 will allow electric power to be supplied to conductive base plate 560 so that the electrode 510 will be immediately activated when depressed.

Figure 16:
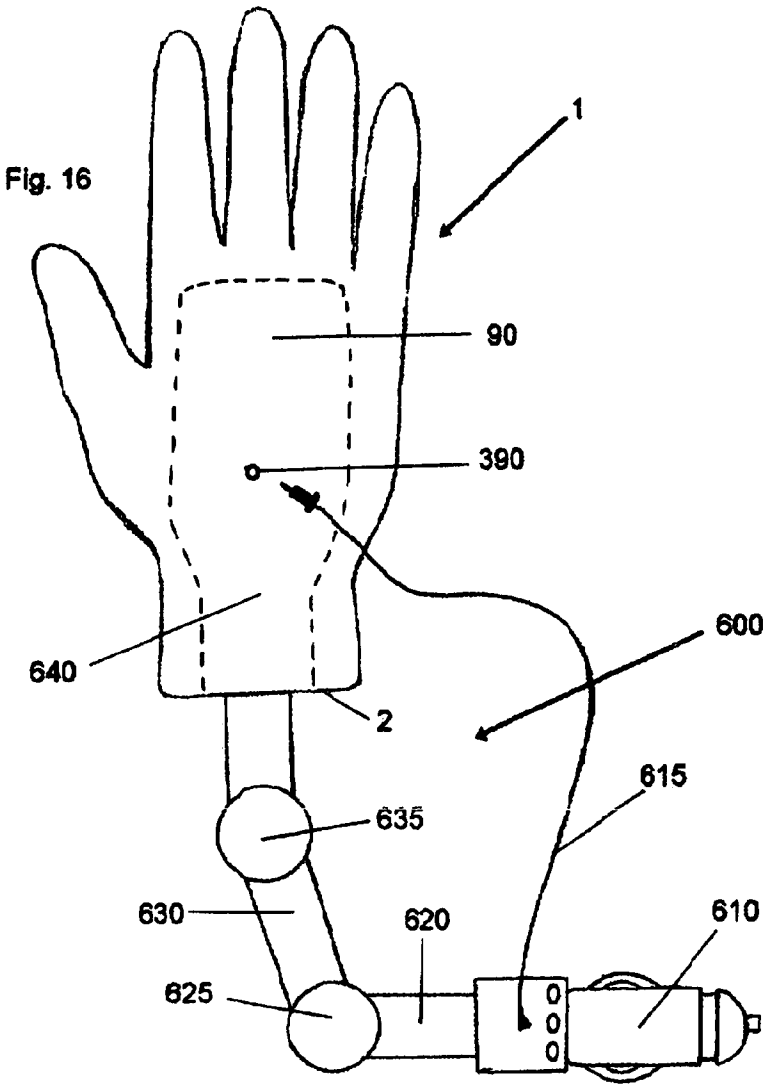
FIG. 16 shows a novel mounting stand and cigarette lighter power adapter for the stun glove.

FIG. 16 shows a novel mounting stand 600 and cigarette lighter power adapter 610 for the stun glove 1 that allows the power supply within the glove to be recharged by power line 615 that connects to a vehicle's power supply by adapter 610. The stand 600 can include bendable arm portions 620, 630 that connect to a cigarette type plug-in power adapter 610 that can plug into a conventional cigarette lighter in a vehicle. The adapter 610 can be attached to bendable arm portions 620, 630 and outer end 640 which can be inserted into the open end 2 of the stun glove 1. Hinged portions 625, 635 can allow the stand 600 to be bendable so that the glove 1 is left in an upright and reachable position while the glove 1 is being recharged. The stand 60 can allow for greater versatility to the user by allowing the glove 1 to be in a ready and available position to be used similar to the placement location of weapons such as shotguns held in place along console areas of police vehicles. Upper mount end 640 can extend partially into the glove so that the user only needs to reach into the hand opening 2 of the glove 1 to access the glove 1 for use.

Figure 17:
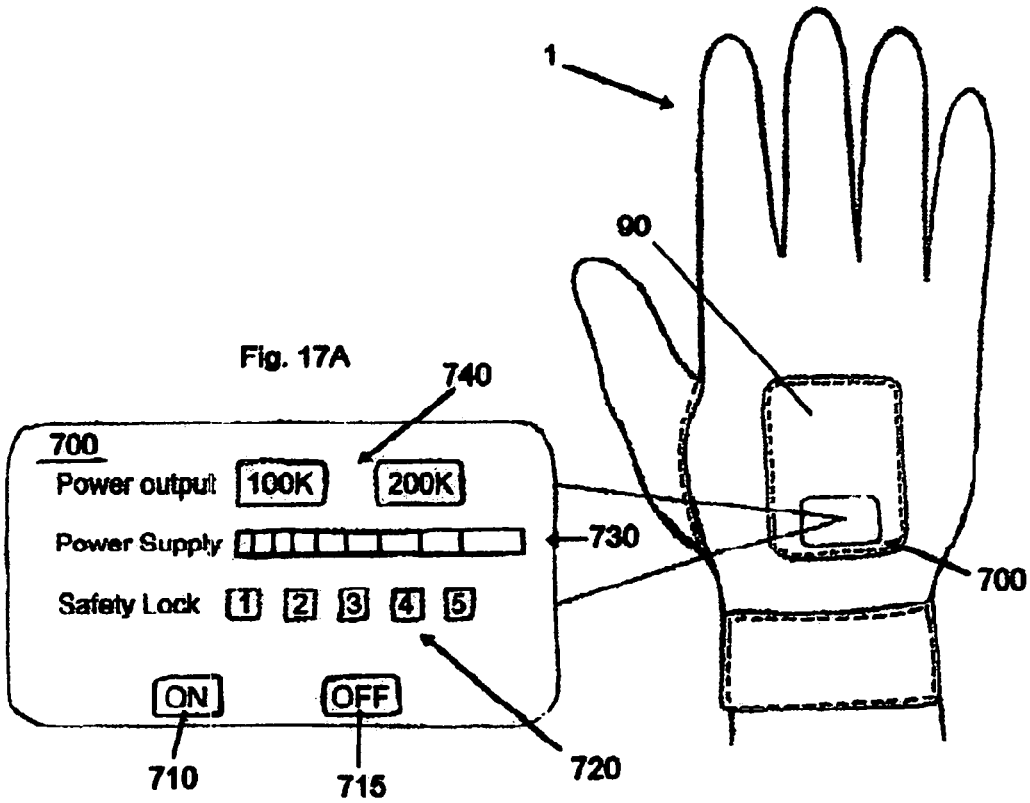
FIG. 17 shows another embodiment of the stun glove with touch screen activation pad.

FIG. 17 shows another embodiment of the stun glove 1 with touch screen activation pad 700. FIG. 17A is an enlarged view of the touch screen pad 700 of FIG. 17. Touch pad 700 can be a thin liquid crystal display pad that can function as the weapon controls for the glove 1. On and off press button switches 710, 715 can be used in place of and/or with the index finger activation switches and pressure sensitive electrodes previously described. Additional safety lock combination press button switches 720 can be programmed to allow glove 1 activation when a selected access code is entered on the panels labeled 1, 2, 3, 4, and 5. A visual readout monitor portion 730 can show power supply availability on the glove in various colors such as but not limited to red, yellow, green, and the like, so that for example, a fully lit rectangle in red shows the glove is fully charged, and different color intensities, and/or a less lit display would be a less amount of power is available. Power shock output can also be adjusted as needed. For example, the user can select different power outputs 740, by depressing different levels such as but not limited to electrode discharges of 100,000 volts, 200,000 volts, and the like.

Figure 18:
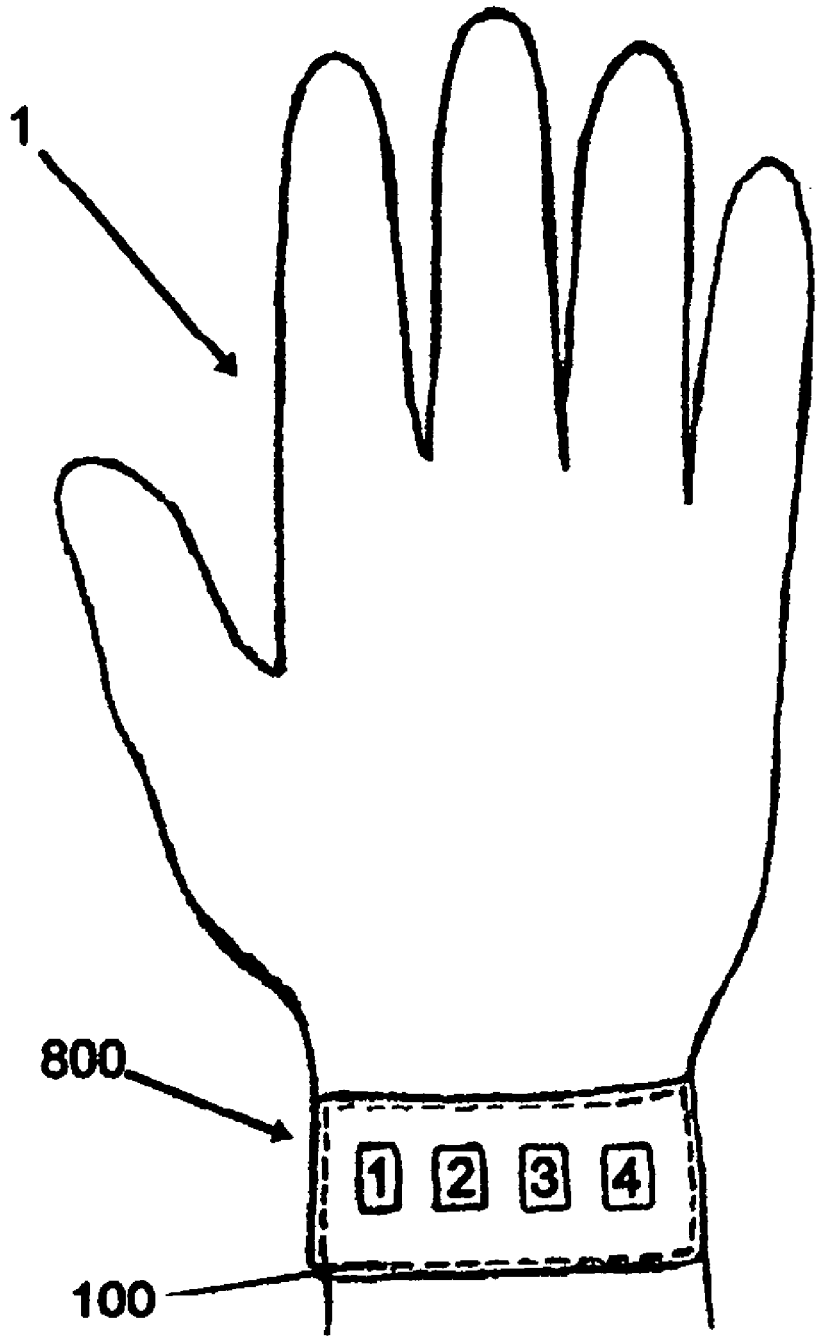
FIG. 18 shows another embodiment of the stun glove with wrist activation buttons.

FIG. 18 shows another embodiment of the stun glove 1 with wrist activation button keypad 800. The novel key pad 800 can be placed about the wrist portion 100 of the glove 1, and be formed from a thin silicone rubber key pad with miniaturized electronics having depressible button portions that also can allow require a user depress a selected access code to activate the glove 1 for use. The code can provide extra safety for glove operation. The novel keypad 800 can be used in place of and/or with the index finger activation switches and pressure sensitive electrodes previously described.

Figure 19:
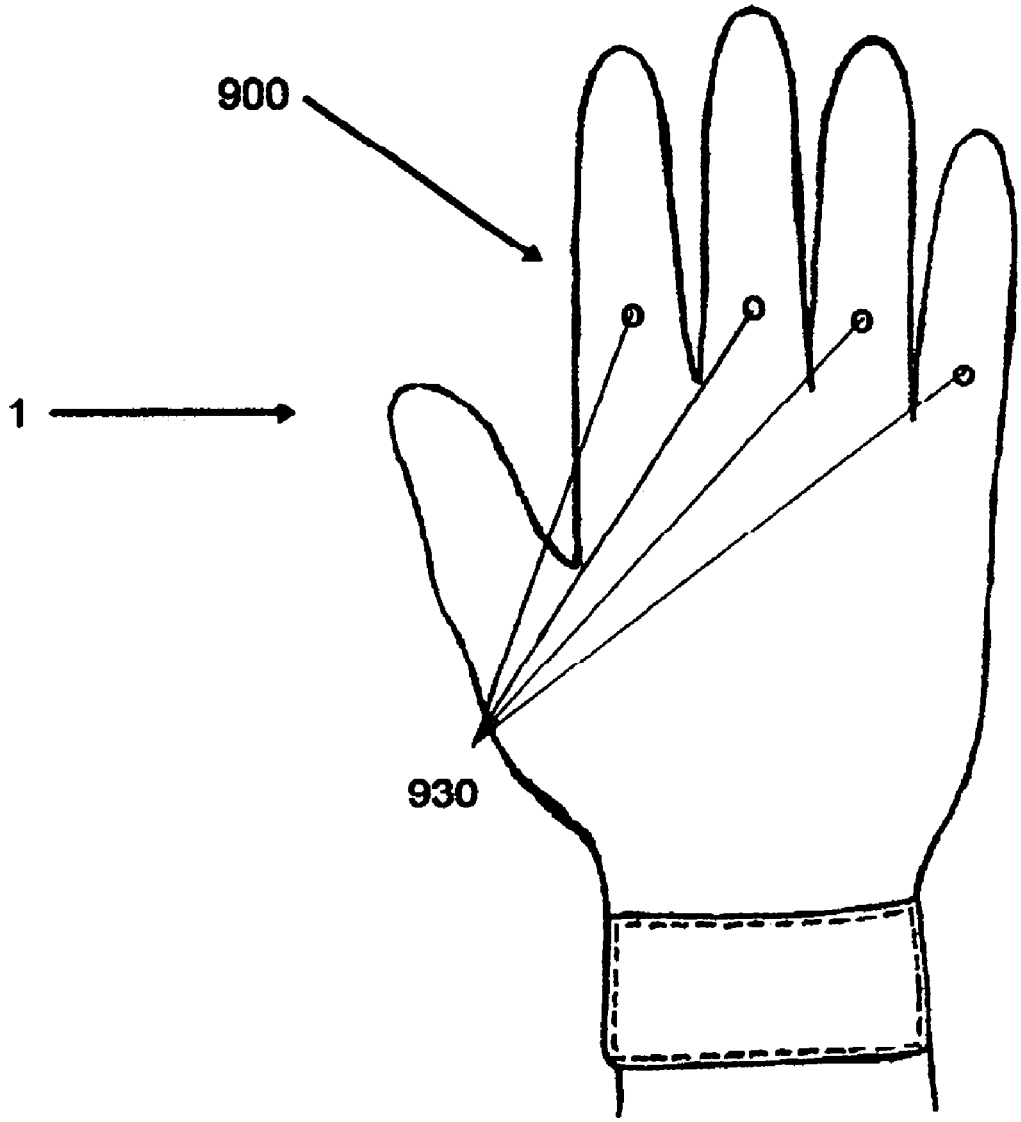
FIG. 19 shows another embodiment of the novel stun glove with plural electrodes on the back of the fingers.

FIG. 19 shows another embodiment of the novel stun glove 1 with plural electrodes 900 on the back of the glove fingers. Here, the user can have electrode discharge across plural electrodes 930, along the back of the user's fingers so that the user can generate shock voltage without having to grip and grab another person. For example, swinging the back of the hand, and/or punching the same hand into contact with another can provide the electric shock discharge. This novel configuration can also be used with any of the embodiments previously described.

Figure 20:
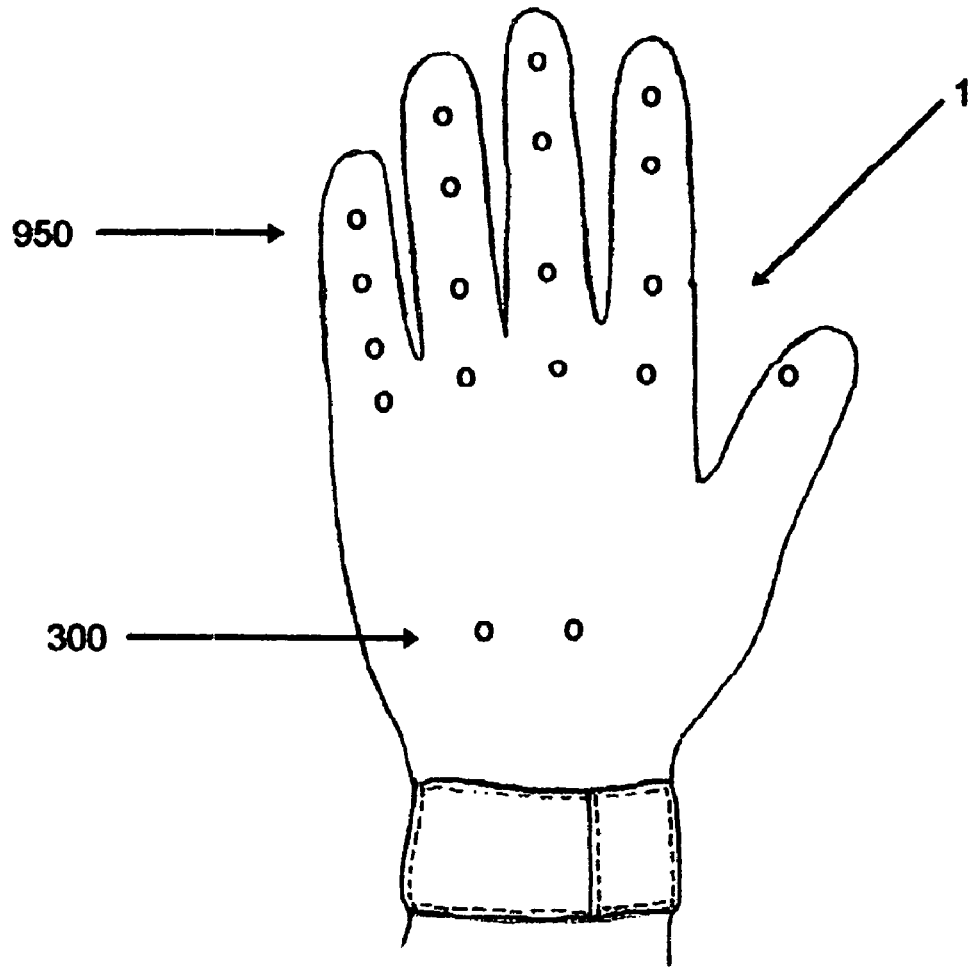
FIG. 20 shows another embodiment of the novel stun glove with plural electrodes across the front of the glove.

FIG. 20 shows another embodiment of the novel stun glove 1 with plural electrodes 950 across the front of the glove that can be along the finger tips, mid finger portions, base of the fingers, upper palm area, and lower palm area 300. Here, the user can have electrode discharge across plural electrodes 930, along the back of the user's fingers so that the user can generate shock voltage without having to grip or grab another. By moving any part of the palm side of the hand, and/or any of the fingers to contact another can provide the electric shock discharge. This novel configuration can also be used with any of the embodiments previously described.

Figure 21:
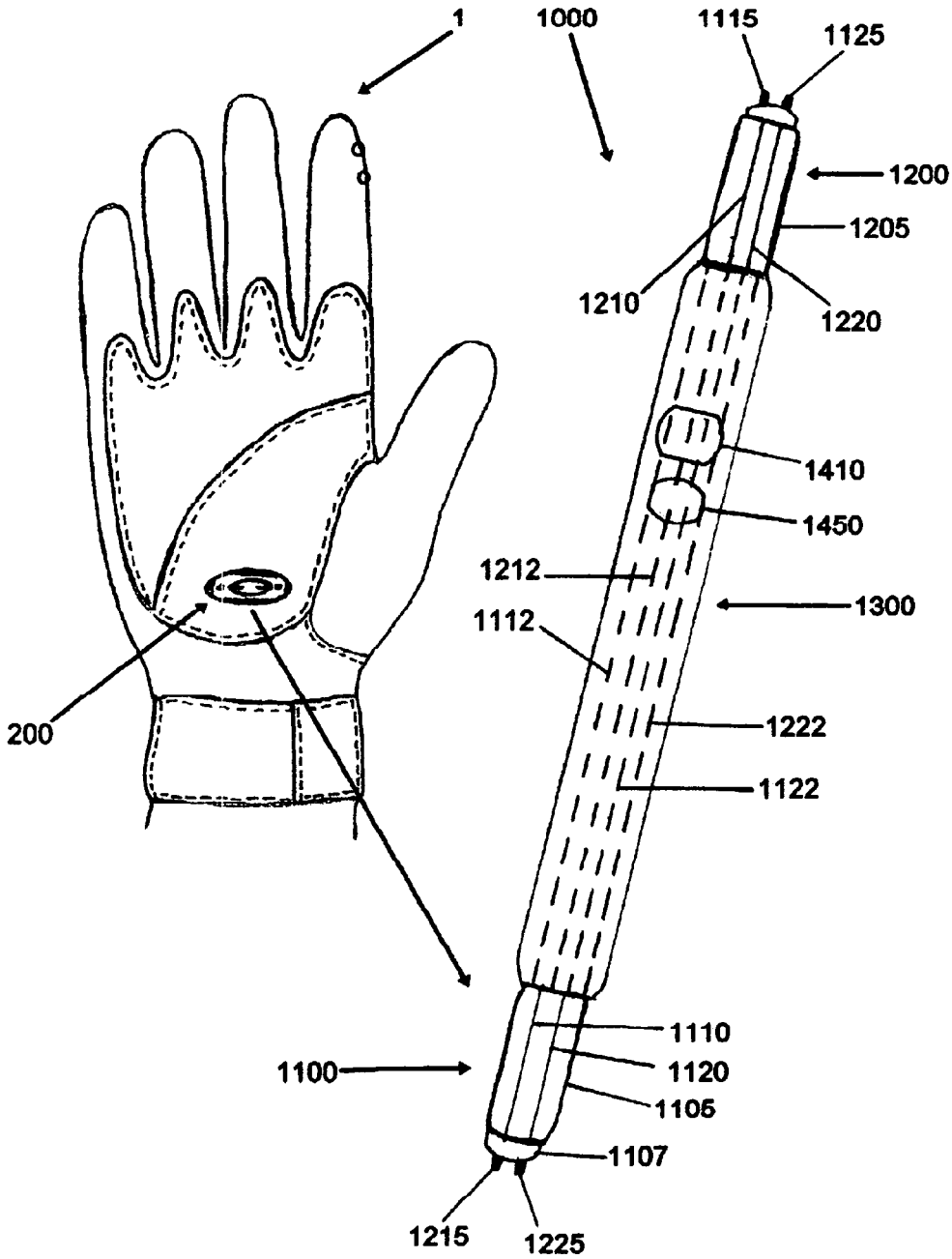
FIG. 21 shows another embodiment of the novel stun glove with stun stick accessory.

FIG. 21 shows another embodiment of the novel stun glove 1 with stun stick accessory 1000. The stun stick accessory can be shaped as a longitudinal type baton up to approximately 1 to approximately 3 feet in length, and have ends 1100, 1200 with diameters of up to approximately several inches or more that allow the user of the glove 1 to grip about the ends 1100, 1200, and a main longitudinal body portion 1300 therebetween. Ends 1100 and 1200 can have a narrower diameter to that of the longitudinal main body so that a user can more easily grip the stun stick 1000.

Lower grip end 1100 can include a main base portion 1105 formed from a nonconductive material such as rubber and the like, that overlays a rigid underbase that can be preformed from molded plastic, and the like. Across the outer surface of end 1100 can be two parallel conductive strips 1110, 1120, made from conductive material such as but not limited to stainless steel, copper coated, gold coated, and the like, that are each wide enough and spaced apart from one another so as to allow the spacing of the electrodes 200 on the glove 1 to be able to contact against. The strips can have various widths and can also be placed in different configurations on the gripping end. The conductive strips 1110, 1120 each connect to wire leads 1112, 1122 that run through the interior of a main longitudinal body 1300 of the stun stick 1000. The main longitudinal body 1300 can also be formed from a solid material such as but not limited to rubber coating over a solid plastic base. The upper ends of the wire leads 1112, 1122 exit the top outer end 1200 of the stun stick as electrodes 1115, 1125.

The stun stick 1000 can also have a reverse configuration, where the upper end 1200 can also function as a grip for being held by the glove 1. End 1200 can include a main base portion 1205 formed from a nonconductive material such as rubber and the like, that overlays a rigid underbase that can be preformed from molded plastic, and the like. Across the outer surface of end 1200 can be two parallel conductive strips 1210, 1220, made from conductive material such as but not limited to stainless steel, copper coated, gold coated, and the like, that are each wide enough and spaced apart from one another so as to allow the spacing of the electrodes 200 on the glove 1 to be able to contact against. The conductive strips 1210, 1220 each connect to wire leads 1212, 1222 that can run through the interior of a main longitudinal body 1300 of the stun stick 1000. The lower ends of the wire leads 1212, 1222 exit the bottom outer end 1100 of the stun stick as electrodes 1215, 1225.

By itself the stun stick can be used as a baton type weapon. With the novel glove 1, the stun stick can become a high voltage weapon. A user wearing glove 1 can grip one end, such as end 1100 so that the electrodes 200 of the glove 1 are in contact with conductive strips 1110, 1120. The conductive strips transfer the electric charge through wire leads 1112, 1122 to exit and discharge out outer electrode ends 1115, 1125 causing a visible and audible discharge effect that can also be effectively used for self defense and enforcement. Grabbing opposite end 1200 in a like manner by glove 1 allows the bottom electrodes 1215, 1225 to become the discharge electrodes. If an attacker/assailant grabs the novel stun stick accessory 1000 away from the wearer of the glove 1, the stun stick 100 loses its ability to become an electric discharge weapon by itself. However, if the glove wearer gains control of the opposite end of the stun stick, an opposite end discharge can cause the attacker/assailant to drop the stun stick and not be able to use it as a weapon. Additional embodiments to the stun stick 1000 can include the incorporation of separate power supplies 1410, such as but not limited to batteries, rechargeable power packs, and the like, similar to those described in reference to the glove 1 embodiments described above.

Additional circuitry 1450, such as amplifiers, capacitors, resistors, and transformers, can also be added to further amplify the discharge effect of the stun stick. Still furthermore, the use of multiple discharge electrodes on different locations of the stun stick, pressure activated electrodes, and the like, can also be used to enhance the effect of the stun stick. Still furthermore, control key pads such as those described above can be incorporated into the stun stick.

The invention can have applicability for self-defense and/or to subdue an attacker/assailant. The invention can be used by law enforcement, security guards, prison guards, air marshals, military, the public, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A stun glove for being worn about fingers, a front-palm and back-hand of a hand, comprising:

an elastic and flexible base material having finger portions, thumb portion and front-palm portion and back-hand portion adapted for substantially covering a hand;

at least two electrodes separated from one another on the glove that extends to an exterior of the glove;

an insulative layer portion beneath the two electrodes;

a power supply for providing a source of electrical power to the electrodes; and a switch located along a tip portion of at least one of the finger portions on the glove, wherein a tip of the thumb portion on the glove contacting the tip portion of one of the finger portions activates and deactivates the power supply to the glove.

2. The stun glove of claim 1, further comprising:

insulative dome shaped tips for covering out tips and sides of the finger portions and the thumb portion of the glove.

3. The stun glove of claim 1, wherein the power supply includes:

an enclosure located on the back-hand portion of the glove, the enclosure for housing both a battery and all electronics for operating the glove.

4. The stun glove of claim 1, wherein the power supply includes:

at least one removable nine (9) volt battery.

5. The stun glove of claim 1, further comprising:

an adjustable control on the glove for adjusting power levels to the electrodes from the power supply.

6. A stun glove for being worn about fingers, a front-palm and back-hand of a single hand, comprising:

an elastic and flexible base material having finger portions, front palm portion and back-hand portion adaptable for substantially covering a hand;

two electrodes adjacent to one another and separated from one another being located on the glove;

an insulative layer portion beneath the two electrodes;

a power supply for providing a source of electrical power to the electrodes; and a switch for activating and deactivating the power supply to the glove, wherein the two electrodes cause a stun effect across to an object that is placed adjacent to the electrodes on the glove, the switch including a pressure sensor switch on the at least one of the electrodes, wherein pressing on the at least one of the electrodes activates the power supply; and an adjustable control on the glove for adjusting power levels to the electrodes from the power supply.

7. The versatile stun glove of claim 6, wherein the at least one of the electrodes and the pressure sensor switch includes:

a conductive dome;

a spring under the metal dome;

a conductive base member separated from the dome by the spring, wherein pressing down causes an electrical contact to occur with the conductive base member and activates the electrodes.

8. The stun glove of claim 6, wherein the power supply includes:

an enclosure located on the back-hand portion of the glove, the enclosure for housing both a battery and all electronics for operating the glove.

9. The stun glove of claim 6, wherein the power supply includes:

at least one removable nine (9) volt battery.

10. A stun glove for being worn about fingers, a front-palm and back-hand of a single hand, comprising:

an elastic and flexible base material having finger portions, front-palm portion and back-hand portion that is adaptable to fit on a hand;

two electrodes on the glove;

an insulative layer portion beneath the two electrodes;

a thin removable power supply being located on the glove, the power supply providing a source of electrical power to the electrodes which cause a stun effect to an object that is placed adjacent to the electrodes; and insulative dome shaped tips for covering outer tips and sides of the finger portions of the glove; and an adjustable control on the glove for adjusting power levels to the electrodes from the power supply.

11. The stun glove of claim 10, wherein the power supply includes:

an enclosure located on the back-hand portion of the glove, the enclosure for housing both a battery and all electronics for operating the glove.

12. The stun glove of claim 10, wherein the power supply includes:

at last one removable nine (9) volt battery.

* * * * *